US005640724A

United States Patent [19]

Holmes

[11] Patent Number: 5,640,724

[45] Date of Patent: Jun. 24, 1997

[54] MAGNETICALLY ACTIVATED LAVATORY DRAIN PLUG

[76] Inventor: John W. Holmes, 989 Forest Rd., Ann Arbor, Mich. 48105

[21] Appl. No.: 427,614

[22] Filed: Apr. 24, 1995

[51] Int. Cl.[6] ..... A47K 1/14

[52] U.S. Cl. ..... 4/689; 4/295; 4/679

[58] Field of Search ..... 4/668, 679, 688, 4/689, 295, 690, 691

[56] References Cited

U.S. PATENT DOCUMENTS

| | | | |
|---|---|---|---|
| 711,863 | 10/1902 | Humphreys | 4/691 |
| 1,501,303 | 7/1924 | Berry . | |
| 2,180,790 | 11/1939 | Brummett | 4/192 |
| 2,405,127 | 8/1946 | Beach | 137/139 |
| 2,533,491 | 12/1950 | McMahon et al. | 137/139 |
| 2,989,758 | 6/1961 | Turek et al. | 4/203 |
| 3,099,019 | 7/1963 | Tiller | 4/200 |
| 3,368,788 | 2/1968 | Padula | 251/65 |
| 3,652,054 | 3/1972 | Layton | 251/65 |
| 3,774,878 | 11/1973 | Martinez | 251/65 |
| 4,042,984 | 8/1977 | Butler | 4/200 |
| 4,338,968 | 7/1982 | Mercier | 138/30 |
| 4,559,971 | 12/1985 | Bradshaw | 137/596.17 |
| 4,564,046 | 1/1986 | Lungu | 137/625.65 |
| 4,794,890 | 1/1989 | Richeson, Jr. | 123/90.11 |
| 4,890,815 | 1/1990 | Hascher-Reichl et al. | 251/129.15 |
| 4,945,579 | 8/1990 | Husting | 4/203 |
| 5,029,807 | 7/1991 | Fuchs | 251/65 |
| 5,039,061 | 8/1991 | Heard et al. | 251/65 |
| 5,069,422 | 12/1991 | Kawamura | 251/129.1 |
| 5,208,921 | 5/1993 | Nicoll | 4/689 |
| 5,272,775 | 12/1993 | Walraven | 4/287 |
| 5,363,519 | 11/1994 | Husting | 4/689 |

FOREIGN PATENT DOCUMENTS

0487215 A2 10/1991 European Pat. Off. .

*Primary Examiner*—Renee S. Luebke
*Assistant Examiner*—Charles R. Eloshway
*Attorney, Agent, or Firm*—Dykema Gossett PLLC

[57] ABSTRACT

A magnetically activated drain plug apparatus employs a permanent magnet placed externally of a plastic or thin non-magnetic drain pipe while another permanent magnet is placed at the lower end of the drain plug. The external magnet can be a ring shaped magnet, a plurality of magnets in a ring held in a support arm or a magnet slideably retained in a rail on the outside of the pipe. The external magnet is operated by a lever linkage or flexible cable that is external to the drain pipe. Moving the external magnet by operating the linkage or the cable attracts or repels the magnet in the drain plug. Consequently, due to the magnetic attraction or repulsion, the drain plug is moved between an open and a closed position. Guide nubs on the interior of the drain pipe and a stem or fins on the drain plug can be interengaged, thereby preventing tilting or rotation of the drain plug while in the up or open position. The emplacement of the linkage or cable on the exterior of the pipe promotes the cleaning of and the ongoing sanitary condition of the apparatus by permitting easy removal of the drain plug and eliminating any mechanical linkage within the drain pipe to actuate the drain plug.

1 Claim, 3 Drawing Sheets

MAGNETICALLY ACTIVATED LAVATORY DRAIN PLUG

BACKGROUND OF THE INVENTION

The field of the invention pertains to an apparatus for use as a drain plug. In particular, the invention pertains to a handle operated lavatory drain plug. Drain plugs are normally operated by a lever linkage device extending into the interior of the drain pipe itself. The lever linkage prevents opening of the drain plug more than about three-eighths of an inch. The presence of the linkage inside the drain pipe causes a sanitary and cleaning problem as waste products flowing in the drain pipe can become entangled with the linkage and drain plug. The linkage also prevents a "snake" from being used to open a clogged drain. Moreover, leaks can occur as the linkage mechanism becomes worn. Thus, no known apparatus exists to facilitate the easy operation and cleaning of a drain plug by eliminating the mechanical linkage into the drain pipe to engage the drain plug.

A variety of magnetically actuated valves have been developed for closed loop piping systems or the piping of hazardous materials. U.S. Pat. No. 2,405,127 discloses a magnetic valve element inside a pipe with a magnetic sleeve about the outside of the pipe. The valve is incorporated into a closed refrigeration loop.

U.S. Pat. Nos. 2,533,491 and 5,039,061 each disclose a pipe valve for corrosive or toxic fluids wherein the magnetic apparatus is completely external to the pipe but provides a sealed external chamber for interior magnets and the linkage to the valve closure element.

U.S. Pat. No. 3,774,878 discloses a magnetic movable internal valve with a dial adjustable external magnet to provide a variety of valve settings. The valve is intended to control flow rates and droplet sizes in laboratory settings.

SUMMARY OF THE INVENTION

The invention is directed to a magnetically activated lavatory drain plug apparatus, but is not limited thereto. Essentially, the invention comprises a lavatory drain plug having a permanent magnet associated with the drain plug. The drain plug is placed into a plastic or non-magnetic drain pipe extending from a lavatory. An external permanent magnet is movably located near the exterior of the pipe. The external magnet may take different configurations as discussed below. One version is the placement of an axially movable annular magnet around the plastic or thin non-magnetic drain pipe.

The apparatus is preferably actuated by moving a lever linkage or flexible cable attached to the external magnet although other means may be envisioned. By moving the external magnet, movement of the magnet in the drain pipe is effected through the phenomenon of magnetic attraction or repulsion, thereby raising or lowering the drain plug.

The necessary normal movement required to operate the drain plug may be approximately ¼ inch to ½ inch. More travel may be provided if the top of the drain plug is to be grasped for removal for a thorough cleaning of the inlet of the drain pipe. However, as no linkage to operate the drain plug is present in the interior of the drain pipe, less buildup of waste products will be found in the interior of the drain pipe and upon the easy removal of the drain plug, a "snake" or other device can be inserted through the drain pipe to unclog a clogged drain.

The drain plug contains guide fins, or the drain pipe has guide hubs or both of the preceding guide means are employed. The guide means may have the modifications in combination to interengage and thereby keep the plug centered and non-rotatable while in the up or open position. The invention can be advantageously employed as a totally new installation or the invention is useful as a retrofit to an existing installed lavatory. While directed to lavatory drains, the invention herein disclosed is not limited thereto but has other uses such as for hot tub and bathtub drains.

For a more complete understanding of the present invention, reference is made to the following detailed description when read in conjunction with the accompanying drawings wherein like reference characters refer to like elements throughout the several views.

DESCRIPTION OF THE PREFERRED EMBODIMENTS

Figure 1:
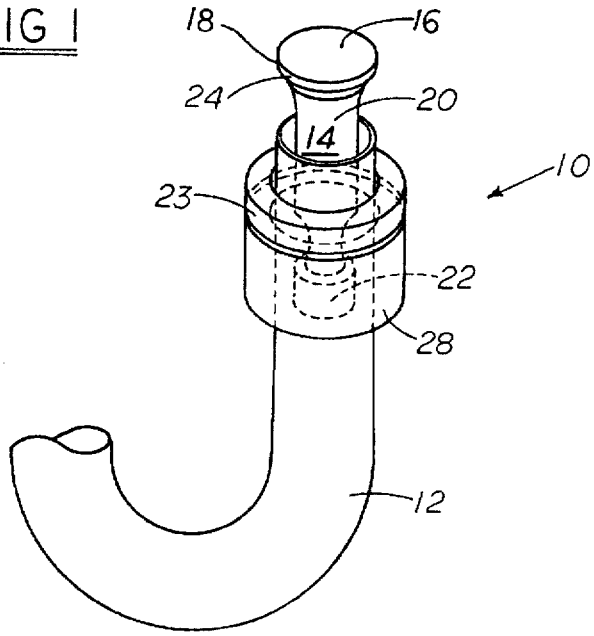
FIG. 1 illustrates a perspective view of the invention showing a movable annular magnet surrounding a drain pipe.

In FIG. 1, a lavatory drain generally denoted as 10 is shown. The drain 10 comprises a drain pipe 12 with a drain plug 14 inserted in the drain pipe 12. The drain plug 14 has a top 16, a sealing edge 18, and a cylindrical stem 20 with a permanent magnet 22 affixed to the stem 20.

The drain plug magnet 22 can be adhered to the stem 20 of the drain plug 14 by attachment means such as adhesives or mechanical means. The magnet 22 can also be molded within the drain plug stem 20 to reduce the potential for oxidation of a metallic magnet otherwise affixed to the outside of the drain plug in the wet environment. Molding the magnet 22 into the drain plug 14 also reduces the potential for the magnet 22 to become disengaged from the drain plug 14 thus rendering the apparatus 10 inoperable. A seal 24 such as an "O" ring can be provided on the sealing edge 18 of the drain plug 14 to improve the sealing of the drain 10.

The drain pipe 12 has an external permanent magnet 28 slideably surrounding the drain pipe 12. The drain pipe magnet 28 is shown as an annular ring magnet, but other configurations can be advantageously employed as is discussed below. If desired, a polytetrafluoro ethylene (Teflon®) coating or other low friction coating can be applied to the inside of the drain pipe magnet 28 to facilitate smooth travel on the outside of the drain pipe 12.

Figure 2:
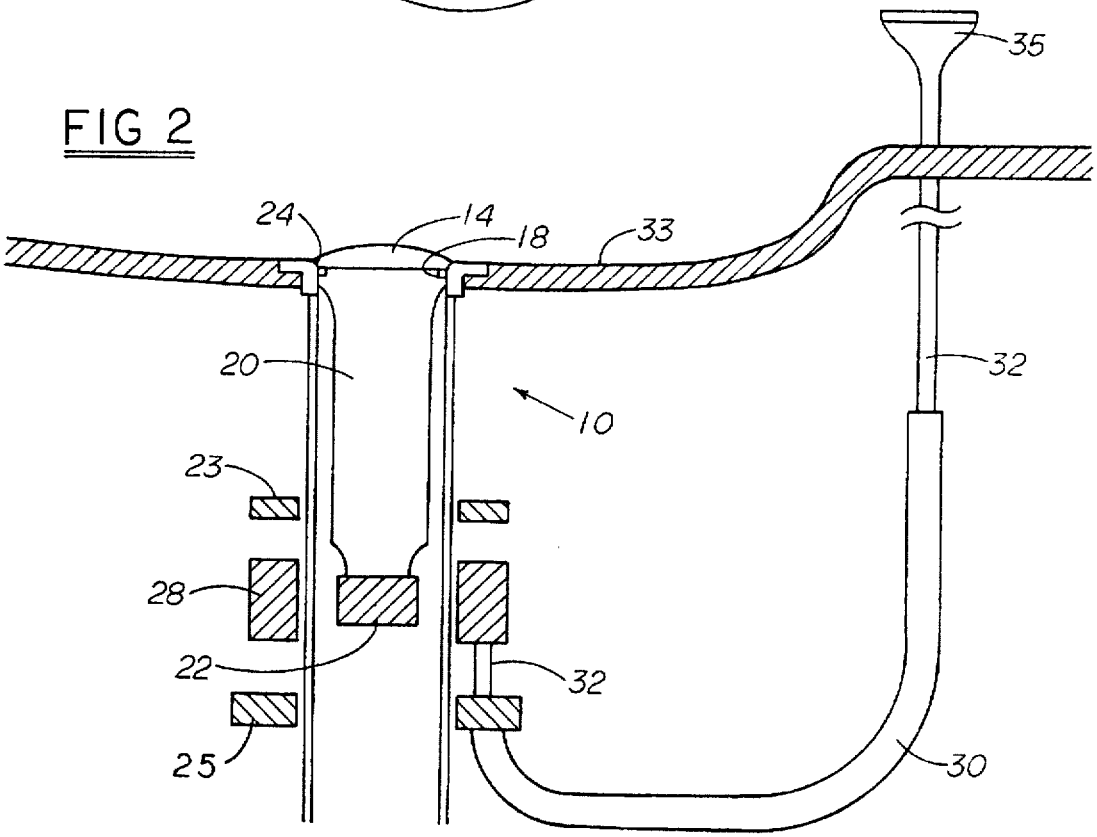
FIG. 2 illustrates a partial sectional side view of the apparatus of FIG. 1 and also shows a cable to operate the annular magnet.

FIG. 2 depicts the drain 10 in greater detail in a partial sectional side view. The relationship of the drain plug magnet 22 with the drain pipe magnet 28 outside of and surrounding the drain pipe 12 is clearly seen. As the drain pipe magnet 28 is moved, the drain plug magnet 22 responds and is positioned accordingly by magnetic attraction or repulsion depending on the relative positions of the N-S poles of the magnets.

In this instance, the external magnet 28 is operated by means for axial sliding 30, such as the cable 32. The cable 32 extends above the sink 33 to a handle 35 for convenient user accessibility. A magnetic stop ring 23 surrounds the drain pipe 12 as an option to assure that the drain pipe magnet 28 remains up as shown in FIG. 1 until positively moved down by the user. A similar stop ring 25 may be located for the lower drain pipe magnet 28 down position to assure that the drain plug remains closed until the drain pipe magnet 28 is positively moved upward. With the cable 32 arrangement as shown pushing the handle 35 down opens the drain plug 14 and pulling the handle up closes the drain plug in the conventional manner. Turning the attachment of the cable 32 to the drain pipe magnet 28 upside down causes the drain plug 14 to open with upward motion of the handle 35 and the drain plug to close with downward motion of the handle, a more logical arrangement. The vertical travel of the drain plug 14 is only limited by the external travel of the drain pipe magnet 28 which can be considerably more than the conventional three-eighths of an inch or so. Other means for axially sliding the external drain pipe magnet are disclosed below.

Figure 3:
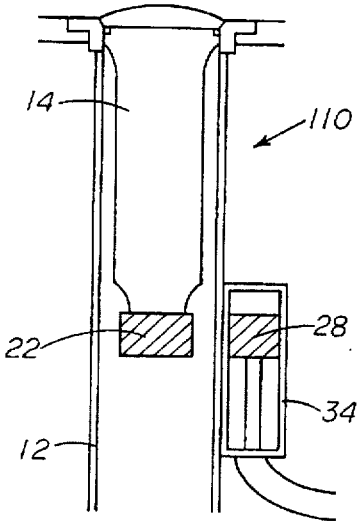
FIG. 3 illustrates a side sectional view of the invention employing an enclosed guide to hold the external magnet.
Figure 4:
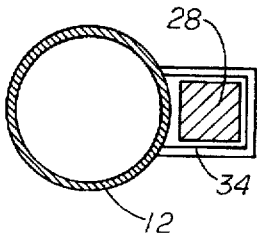
FIG. 4 illustrates a top view of the guide and external magnet of FIG. 4.
Figure 5:
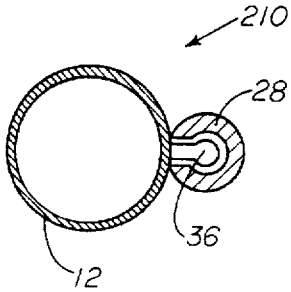
FIG. 5 illustrates a sectional view of a rail to support an external magnet.

A variation 110 of the apparatus maintains the drain pipe magnet 28 in operable proximity to the drain plug magnet 22 as shown in sectional view in FIG. 3. A guide 34 is mounted to a side of the drain pipe 12. The drain pipe magnet 28 is retainably held inside the guide 34 with enough clearance to allow the drain pipe magnet 28 to slide for the travel requisite to operate the drain plug 14. The constraining of the drain pipe magnet 28 within the guide 34 is better shown in section in FIG. 4 wherein the drain pipe magnet is clearly boxed in.

A further variation 210 of the apparatus for maintaining the drain pipe magnet 28 involves configuring the drain pipe magnet 28 to slideably partially surround a vertical protuberance 36 extending from the drain pipe 12. The drain pipe magnet 28 must have sufficient magnetic strength to repeatably attract and axially move the drain plug magnet 22. Moreover, the drain pipe 28 magnet must be capable of being moved easily for a desired vertical distance.

Figure 6:
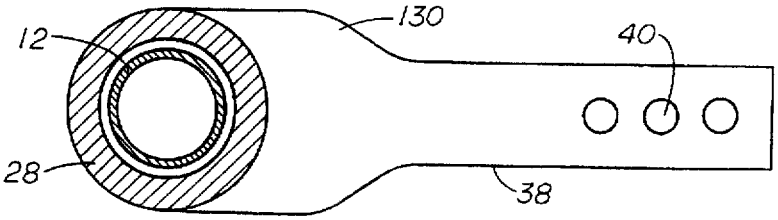
FIG. 6 illustrates a support arm holding an annular magnet around the drain pipe.
Figure 7A:
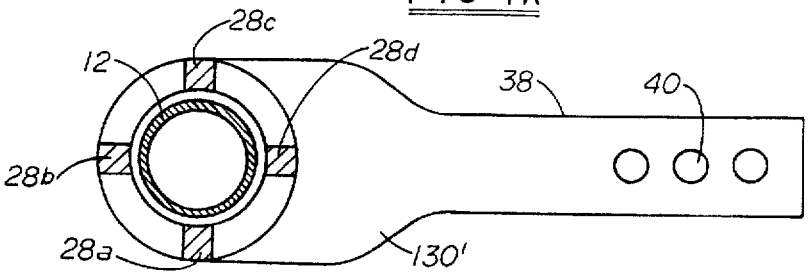
FIGS. 7A and 7B illustrate support arms holding multiple magnets on the outside of the drain pipe.
Figure 7B:
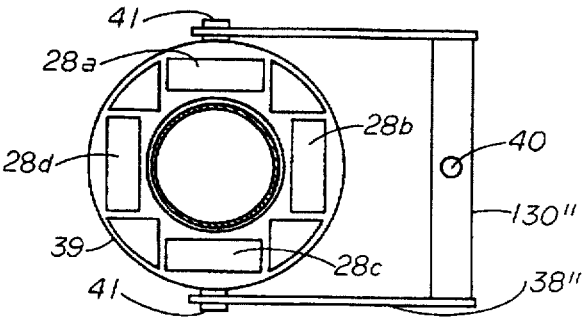

An alternate means for sliding 130 the drain pipe magnet 28 comprises a support arm 38 surrounding the drain pipe 12 as shown in FIGS. 6 and 7. An annular drain pipe magnet 28 is deployed on the support arm 38 in FIG. 6. A variation of the means for sliding 130' is depicted in FIG. 7. The drain pipe magnet 28 can take the form of a multiplicity of magnets **28*a*, 28*b*, 28*c*, 29*d*, disposed on the support arm 38 surrounding the drain pipe 12. A second variation of the means for sliding 130" is shown in FIG. 7B. The support arm 38" in this view is attached to a magnet holder 39 which in turn holds the plurality of magnets 28*a*, 28*b*, 28*c* and 28*d*. The attachment comprises pivots 41 that allow for misalignment with the drain pipe 12 or rod 42**.

Figure 8:
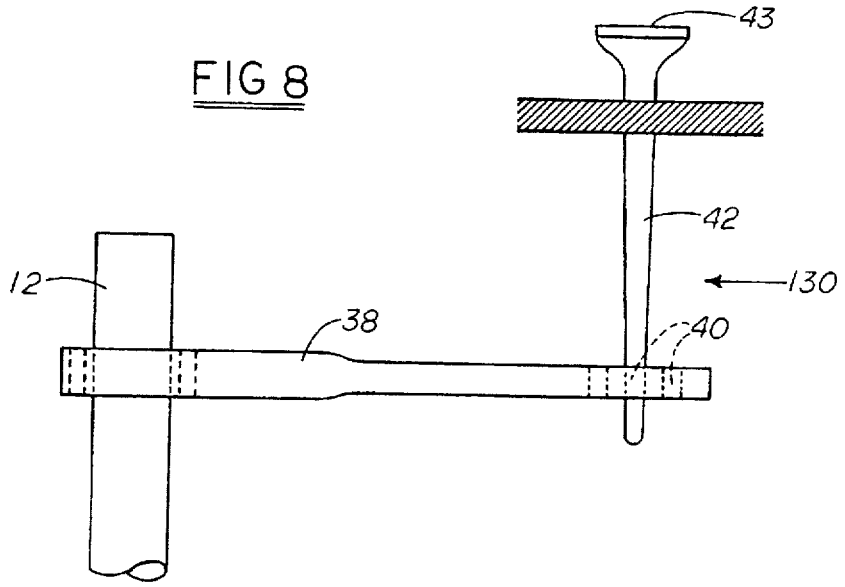
FIG. 8 illustrates a side view of a linkage to operate the support arm of FIGS. 6 and 7.

The support arm 38 contains one or a plurality of apertures 40. As best shown in FIG. 8 the apertures 40 are for connecting a linkage 42 thereby controlling the operation of the arm 38 with a control knob or handle 43. The embodiment of FIGS. 6, 7 and 8 is particularly useful for retrofit installations although not limited thereto. In this embodiment the drain plug 14 opens with upward movement of the control knob 43, the more logical approach. The cable 32 installations above are also useful for retrofit installations and where the location of the handle or knob 35 is not behind the lavatory adjacent the spigots. The cable 32 and arm 38 examples are for illustrative purposes as any number of configurations might be employed to raise and lower a drain pipe magnet 28 which in turn causes the drain plug magnet 22 to follow and raise the drain plug 14.

Figure 9:
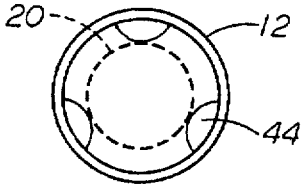
FIG. 9. illustrates a top view into the opening of the drain pipe for a cylindrical drain plug stem.

In FIG. 9 three nubs 44 are shown extending inwardly from the wall of the drain pipe 12. The nubs 44 loosely engage the cylindrical stem 20 (shown here ghosted) of the drain plug shown in FIGS. 1, 2 and 3. The hubs 44 keep the drain plug 14 vertically axially aligned when raised.

Figure 10:
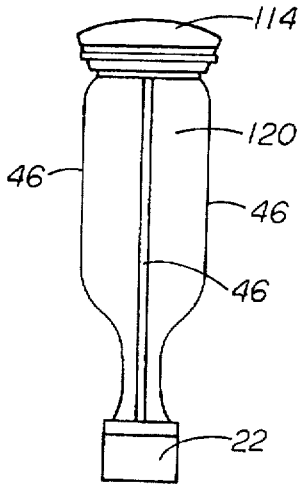
FIG. 10 illustrates a side view of a finned drain plug with a magnet.
Figure 11:
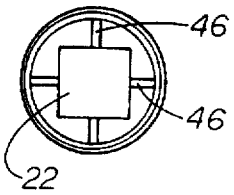
FIG. 11 illustrates a bottom view of the drain plug of FIG. 10.

In FIGS. 10 and 11 an alternate drain plug 114 is shown in detail.

FIG. 10 depicts fins 46 comprising the stem 120 on the underside of the drain plug 114 for placement in a drain pipe lacking the guide nubs 44 of FIG. 9. The fins 46 are sized to provide the axial alignment when the drain plug 114 is raised. When guide nubs 44 are provided they can engage the fins 46 and prevent excessive rotation of the drain plug 114 when inserted in the drain pipe 12. FIG. 11 shows a view from beneath the drain plug 114 locating the fins 46 at 90 degrees to each other above the magnet 22.

Figure 12:
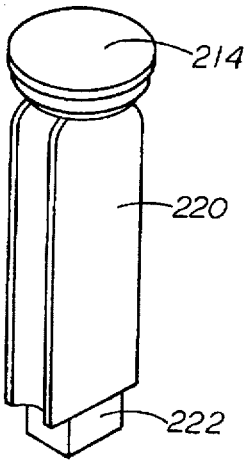
FIG. 12 illustrates a side view of a drain plug having a rectangular stem and modifications on the edges of the stem.
Figure 13:
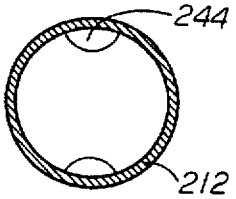
FIG. 13 illustrates a top view into a drain pipe having two directly opposed guide nubs.
Figure 14:
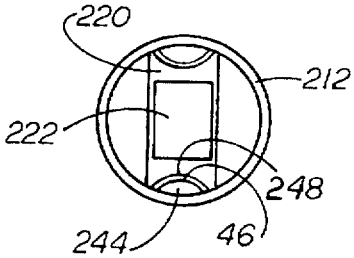
FIG. 14 illustrates a sectional view through the modified rectangular stem of the drain plug of FIG. 12 as the drain plug interengages with the guide nubs of the drain pipe of FIG. 13.

FIGS. 12–14 show a modification in the form of a single rectangular stem 220 and guide nubs 244 to control rotation of the drain plug 214. As can particularly be seen in FIG. 12, the stem 220 has arcuate concavities 248 on the edges of the stem 220. Two guide nubs 244 are depicted as disposed opposite each other on the interior of and extend into the drain pipe 212 in FIG. 13. The emplacement of the drain plug 214 of FIG. 12 to the drain pipe 212 of FIG. 13 is sectionally shown in FIG. 14. The arcuate concavities 248 on the edges of the stem 220 on the drain plug 214 closely conform to the guide nubs 244 of the drain pipe 212. Consequently, the drain plug 214 is limited from rotational turning while in the drain pipe 212 whether raised or lowered by an external magnet acting on the stem magnet 222.

Applicant's experiments have shown that relatively inexpensive common magnetic materials may be used for the plug 22 and pipe 28 magnets. These may be employed in a variety of configurations as illustrated above. Thus, relatively powerful magnets of expensive exotic materials are not required to provide sufficient force to raise the drain plug 14 and column of water thereabove in a full lavatory sink. The more powerful magnets might be employed where there is a severe constraint on size adjacent the drain or where the column of water above the drain plug is considerably greater as in a bathtub or hot tub.

I claim:

1. An apparatus for magnetically opening and closing a lavatory drain, the apparatus comprising a non-magnetic drain pipe;

a first magnet disposed eternally and near an outside of the non-magnetic drain pipe, the first magnet being selectable movable;

a drain plug;

a second magnet affixed to the drain plug, said second magnet being in relatively close proximity to the first magnet;

means for sliding said first magnet, said magnetic sliding means having an arm slideably surrounding the outside of the non-magnetic pipe said arm including a magnet holder pivotally attached to said arm, said first magnet being mounted to said magnet holder;

whereby when the first magnet is moved, the second magnet responds to the movement of the first magnet thereby causing the drain plug to open the entrance to the drain pipe.

* * * * *

UNITED STATES PATENT AND TRADEMARK OFFICE

CERTIFICATE OF CORRECTION

PATENT NO. : 5,640,724

DATED : June 24, 1997

INVENTOR(S) : John W. Holmes

It is certified that error appears in the above-indentified patent and that said Letters Patent is hereby corrected as shown below:

Column 5, line 4 - eternally now reads externally.

Column 5, line 7 - selectable now reads selectably.

Column 6, line 3 - a comma is inserted after pipe.

Signed and Sealed this

Twenty-third Day of September, 1997

*Attest:*

Bruce Lehman

BRUCE LEHMAN

*Attesting Officer*

*Commissioner of Patents and Trademarks*